US009289061B2

(12) United States Patent
Shoenfeld

(10) Patent No.: US 9,289,061 B2
(45) Date of Patent: Mar. 22, 2016

(54) SECURE FILE CABINET

(71) Applicant: Norman A. Shoenfeld, Cypress, TX (US)

(72) Inventor: Norman A. Shoenfeld, Cypress, TX (US)

(73) Assignee: S&S X-Ray Products, Inc., Pen Argyl, PA (US)

( * ) Notice: Subject to any disclaimer, the term of this patent is extended or adjusted under 35 U.S.C. 154(b) by 107 days.

(21) Appl. No.: 14/185,225

(22) Filed: Feb. 20, 2014

(65) Prior Publication Data

US 2014/0167574 A1 Jun. 19, 2014

Related U.S. Application Data

(63) Continuation-in-part of application No. 13/765,146, filed on Feb. 12, 2013, now Pat. No. 9,078,520, which is a continuation-in-part of application No. 13/291,462, filed on Nov. 8, 2011, now Pat. No. 8,700,211.

(51) Int. Cl.

| | |
|---|---|
| ***A47B 63/00*** | (2006.01) |
| ***E05B 47/00*** | (2006.01) |
| ***E05B 65/46*** | (2006.01) |

(52) U.S. Cl.

CPC ..... *A47B 63/00* (2013.01); *E05B 47/0012* (2013.01); *E05B 65/462* (2013.01); *A47B 2210/08* (2013.01); *E05B 2047/0068* (2013.01)

(58) Field of Classification Search

CPC ..... A47B 81/00; A47B 88/00; A47B 88/20; A47B 96/00; A47B 2088/011; A47B 2210/0086; A47B 2210/02; A47B 2210/08; A47B 2220/0091; A61J 7/0069; E05B 65/0003; E05B 65/44; E05B 65/46; E05B 65/462

See application file for complete search history.

(56) References Cited

U.S. PATENT DOCUMENTS

| | | | | |
|---|---|---|---|---|
| 4,114,965 | A | 9/1978 | Oye et al. | |
| 4,303,287 | A | 12/1981 | Taplin | |
| 4,704,517 | A | 11/1987 | Campisi et al. | |
| 5,158,347 | A * | 10/1992 | Warren et al. | 312/319.8 |
| 5,199,774 | A | 4/1993 | Hedinger et al. | |
| 5,248,195 | A | 9/1993 | Shin | |
| 5,745,366 | A * | 4/1998 | Higham et al. | 700/242 |
| 6,116,461 | A * | 9/2000 | Broadfield et al. | 221/98 |

(Continued)

FOREIGN PATENT DOCUMENTS

| | | | | |
|---|---|---|---|---|
| KR | 1020070012032 A * | 1/2007 | | E05B 65/44 |
| KR | 200440074 Y1 * | 5/2008 | | A47B 88/12 |

*Primary Examiner* — Daniel J Troy
*Assistant Examiner* — Andrew Roersma
(74) *Attorney, Agent, or Firm* — Bernhard P. Molldrem, Jr.

(57) ABSTRACT

A controlled access file cabinet permits an authorized user access only to one file drawer or one locked compartment at a time. The cabinet has at least one pull-out drawer with a lock mechanism that self-locks when the drawer is pushed in and closed, and has an electro-mechanical servo to release the drawer for authorized access. One or more drawers may be divided into a row of locked compartments. Slide bar lock mechanisms interact with with lock pins on hinged lids or covers for the compartments. Only one compartment can be opened at a time. A control board within the cabinet ensures that all drawers are closed and latched before any can be released. The secure cabinet may be connected with a network, or by i2c or daisy chain to other secure file cabinets, including cabinets retro-fitted with a bolt-on lock mechanism. Computer software limits access to certain areas of the cabinet to specific authorized users, and maintains inventory and audit trail over multiple cabinets.

18 Claims, 13 Drawing Sheets

(56) References Cited

U.S. PATENT DOCUMENTS

| | | | | |
|---|---|---|---|---|
| 7,052,097 | B2 * | 5/2006 | Meek et al. | 312/222 |
| 7,426,425 | B2 * | 9/2008 | Meek et al. | 700/237 |
| 7,668,620 | B2 * | 2/2010 | Shoenfeld | 700/237 |
| 7,719,420 | B2 | 5/2010 | Christie et al. | |
| 2004/0118215 | A1 * | 6/2004 | Reasoner et al. | 73/760 |
| 2007/0228899 | A1 * | 10/2007 | McFarland | 312/221 |
| 2009/0224638 | A1 * | 9/2009 | Weber | 312/209 |
| 2011/0012491 | A1 * | 1/2011 | Rahilly | 312/333 |
| 2011/0140831 | A1 * | 6/2011 | Michael | 340/3.31 |
| 2011/0156560 | A1 * | 6/2011 | Michael | 312/310 |
| 2011/0196538 | A1 * | 8/2011 | Michael | E05B 47/00 700/275 |
| 2012/0004772 | A1 * | 1/2012 | Rahilly et al. | 700/237 |

* cited by examiner

SECURE FILE CABINET

This is a continuation-in-part of copending U.S. patent application Ser. No. 13/765,146, Feb. 12, 2013, now U.S. Pat. No. 9,078,520, Jul. 14, 2015, which is a continuation-in part of U.S. patent application Ser. No. 13/291,462, Nov. 8, 2011, now U.S. Pat. No. 8,700,211, Apr. 15, 2014.

BACKGROUND OF THE INVENTION

This invention relates to cabinets for secure storage of paper documents and other materials that need to be safeguarded, either for reasons of privacy and confidentiality, or to protect high-value items from pilferage and theft. The invention is more particularly concerned with a secure file cabinet with locking file drawers, in which the drawers and/or compartments can be locked and which provide for access only when authorized.

The invention is directed to a locking file cabinet, with pull-out file drawers (which may be either "vertical" or "lateral"), with electro-mechanical latching of the file drawers, including servo-motor release of the drawer latch mechanism and sensors to detect whether each drawer is open or is pushed in and latched shut. The invention is more particularly concerned with a secure file cabinet with limited access and with accountability of access, and which may assist in the prevention of fraudulent access and reduction of errors, e.g., errors in confidential customer or personnel records. Some of the file drawers may feature compartments with individual locking lids with servo-motor controlled release of the lid of the compartment for which access is required. The secure filing cabinet may also feature a key-based lock over-ride.

Current locking file cabinets require a key lock for the cabinet or a key lock on each drawer. These file cabinets may have a vertical locking bar within the frame of the cabinet. The vertical locking bar is lifted with cam action if any one drawer is opened so that the remaining drawers are held locked, and the other drawers cannot be pulled out until the open drawer is pushed back in. Other locking filing cabinets may have a combination lock and an interlock system with cables that are moved to permit only a given drawer to be opened and accessed.

Favorably, the secure filing cabinet should have drawers that lock automatically when pushed in and closed, and where only one drawer may be opened and pulled out at a time. This both provides document security, and also prevents instability that may be caused by having the weight of more than one filing drawer extended out in front of the base of the cabinet. Other features should include software-controlled access, i.e., password and ID protected, which may use some combination of barcodes, RFID chips, biometrics, magnetic stripes, or another security technology. The cabinet should provide a full audit trail, i.e. complete history and information of who used a file, who had access to the file, when it was removed and when returned, and where a file is or was. This may include bar code technology to scan a file in when placing it into the filing cabinet and to scan it when it is removed. A centralized networked database may keep track of the stored files in a cabinet, and may keep current records of stored files over multiple cabinets, which may be linked together via i2c or daisy chain technology. A compartmentalized drawer (or drawers) within the cabinet may be used to give access one at a time to multiple sections or compartments in the drawer.

These features can be manufactured into the cabinet, but the filing system may also provide for the secure locking feature to be retrofitted into an existing filing cabinet, for example, to upgrade the cabinet using a separate bolt-on remote lock, and thus provide not only electronic remote locking and unlocking, but also options of bar code scanning and audit trail to the upgraded filing cabinet.

One drawer of the secure filing cabinet may be used as a secure waste bin, to store confidential documents prior to shredding or other destruction, so as to have the advantages of electronically limited access and audit trail. This functionality may be carried out with a bolt-on or stand-alone module (with drop-in slot) and with locked servomotor access (with pass codes) to retrieve the documents for shredding/destruction. The module may contain a removable bin.

It is desirable to maintain a record of which what records are stored in each filing cabinet, and in which drawer, or in which locking-lid compartments of which the drawers, and to unlock the one specific compartment lid for a given record or document item when it is needed to access the same.

The cabinet may also have the added functionality of limiting access to certain drawers or certain compartments within drawers to specific users, keeping other users out of these storage areas. This can be used to keep information, for example, information of or concerning celebrities or politicians, out of reach of the majority of users, and restricted to those employees only that have the appropriate clearance to access these files.

These secure cabinets may incorporate USB or i2c connections and may be capable of IP addressable configurations, for access over a network, to a personal computer, tablet, or hand-held device. The electronic latching mechanisms, and compartment lid lock/unlock mechanisms may be favorably powered by low-voltage DC, e.g., 12 volts, so that no dangerous voltages are present that may shock or injure the authorized personnel accessing the filing cabinet. Battery power is an option.

OBJECTS AND SUMMARY OF THE INVENTION

Accordingly, it is an object of the present invention to provide a secure filing cabinet arrangement that constitutes an improvement over filing cabinets of the prior art, and which can provide authorized secure access to documents stored within the cabinet and which can be accessed remotely.

It is another object to provide a filing cabinet with one or more pull-out drawers, which unlatch automatically under computer control, and which automatically latch shut when the drawer is pushed in to a closed position.

A further object is to provide a secure filing cabinet that permits only one drawer to be pulled out at a time to an open position, and in which the drawer must be pushed in and latched closed to permit access to another drawer.

A still further object is to provide a secure filing cabinet in which one of the drawers is divided into individual compartments, and each with a locking lid or cover, to limit authorized access to a specific compartment only at one given time.

It is still another object to provide a cabinet that limits access to only one compartment within the drawer at a time, and which denies access to any other compartments at the time the drawer has been opened.

It is a more specific object to provide a secure filing cabinet in which the latching mechanism of each drawer's compartments is a straightforward, electro-mechanical design, of a limited number of parts, and avoids the mechanical interlocking mechanisms of the prior art.

A further object is to provide a secure file cabinet with controlled, user-specific access, whereby certain users have access only to select areas of the cabinet, and not to other areas. In this regard it is a more specific object that access to the various areas in the cabinet have access limited only to specific users, which may be password protected also.

In accordance with an aspect of the present invention, storage cabinet arrangement provides for secure storage of documents and/or other materials for which limited authorized access is to be provided. The cabinet has left and right side walls, a rear wall, and a front frame having at least one drawer opening.

At least one respective sliding file drawer is mounted in an associated one of the at least one aperture of the front frame and having at least one back wall, the file drawer being adapted to be pulled proximally out from said cabinet to an open position. This permits access to contents of the file drawer. The drawer is pushed distally in to the cabinet to a closed position in which the back wall of the file drawer is positioned adjacent the rear wall of the cabinet.

A locking mechanism releasably locks the at least one file drawer in its closed position within the cabinet. This mechanism unlatches electro-mechanically to permit access. The locking mechanism includes, for each such file drawer, a latch pin affixed onto the back wall of the drawer in a position oriented parallel to the back wall of the drawer, and a latch mechanism mounted on the rear wall of the cabinet and aligned with the latch pin of the respective file drawer. In an embodiment of this invention, the latch mechanism employs a mechanical latch hook that engages the latch pin in a locked position when said latch pin is pushed into engagement with it. A latch release lever is coupled to the latch hook and moves the latch hook to release the latch pin so that the drawer may be pulled out to its open position. A servomotor or other electro-mechanical actuator is coupled to the latch release lever, e.g., by means of a cable or chain.

A controller board mounted within the cabinet has an input and at least one output. The output(s) are coupled to the respective electro-mechanical actuator(s) for the filing cabinet drawers which are held closed by the respective latch mechanism(s). An interface arrangement is coupled to the input of the controller for permitting an authorized person to interface with the controller to release the latch mechanism from the latch pin of one of the at least one file drawer to permit the drawer to be pulled out to its open position. The interface arrangement can be a card reader, touch-screen computer, or other device that can identify the authorized user and signal the controller to provide access. In some cases, the unlatch signal can originate from a control computer that is located remote from the cabinet.

The latch mechanism can include, for each drawer, a presence sensor mounted on the latch mechanism and arranged so as to detect when the associated file drawer has been pushed in to its closed position. This provides a presence signal, and the controller has one or more inputs receiving the presence signals from the presence detectors of the latch mechanisms. The controller is operative to energize any of said electro-mechanical actuators, and release the latch for a given drawer, but only if the presence signals indicate that all of the drawers are in the closed position.

In a favorable embodiment, one or more of the file drawers is divided in to a row of individual locking compartments. This drawer comprises a front wall and left and right side walls extending from the front wall to the back wall. The right and left side walls each include an elongated channel portion extending along the top from the back wall to the front wall. A plurality of transverse dividers are situated between the left and right side walls and define individual storage compartments within the file drawer.

Each of said the individual locking compartments has a lid that is normally locked down but is selectively releasable to permit the lid to open for access to the associated compartment, with the lid having a hinge pin extending out of a rear portion thereof and journaled in the left and right side walls. These hinge pins permit the lid to pivot from a lowered, closed position to a raised, open position. Lock pins extends from the right and left edges of the lid into the respective channel portion. There are left and right locking slide bars disposed in the respective channel portions of the side walls and these slide bars are adapted to move for at least a limited distance along the respective channel portions. The slide bars each have slots along one or the other side edge and these slots align with the respective lock pins of the compartment lids when the slide bars are moved to different respective positions along the channel portions. Any compartment lid, in which the lock pins align with the respective slots in the slide bars, may be lifted open, but the remaining lids in the file drawer are blocked from opening.

A pair of controlled motor mechanisms on the back wall of the compartmented file drawer move the slide bars to the appropriate positions so as to align, at each selected position, given slots of the left and right slide bars with the lock pins of an associated compartment to permit the lid to be lifted open, and at the same time to lock each of the other of the lids from opening.

In the drawer with individual locking bins, the controlled motor mechanisms may include first and second gear motors mounted on the back wall adjacent left and right sides. Each of these motors has a toothed pinion, and the associated slide bars each have a gear rack disposed at its distal end.

Each such gear motor is operative to move the respective slide bar only when the drawer is detected to be in its closed position, and is inhibited from moving the respective slide bar when the file drawer is in its open position. Favorably, the second gear motor is actuated to move its associated slide bar and only after that associated slide bar is in its desired position the other of the gear motors is actuated to move its associated slide bar to its desired position. Moving the slide bars one a time reduces the amount of current needed to unlock the lid. When the drawer is pushed closed, the two slide bars are again moved, one at a time, to their home or all-lock position.

This aspect of the present invention individually locks each of the divided compartments within each drawer, allowing access to only one divided section of the drawer at a time. This requires access authority to be fed in to the controller or interface for each compartment one at a time, and ensures that only one bin or compartment can be accessed at a time. The user will not have access to the entire contents of a drawer when opened. This reduces the opportunity for the inadvertent access to materials for which the user is not authorized access. Favorably, the gearmotors can move the slide bars only when the drawer is closed, and are inhibited from moving the slide bars when the drawer has been pulled open, to block access to more than one compartment at any one time.

The above and many other objects, features, and advantages of this invention will become apparent from the ensuing description of a selected preferred embodiment, which is to be considered in connection with the accompanying Drawing.

DETAILED DESCRIPTION OF THE PREFERRED EMBODIMENT

Figure 1:
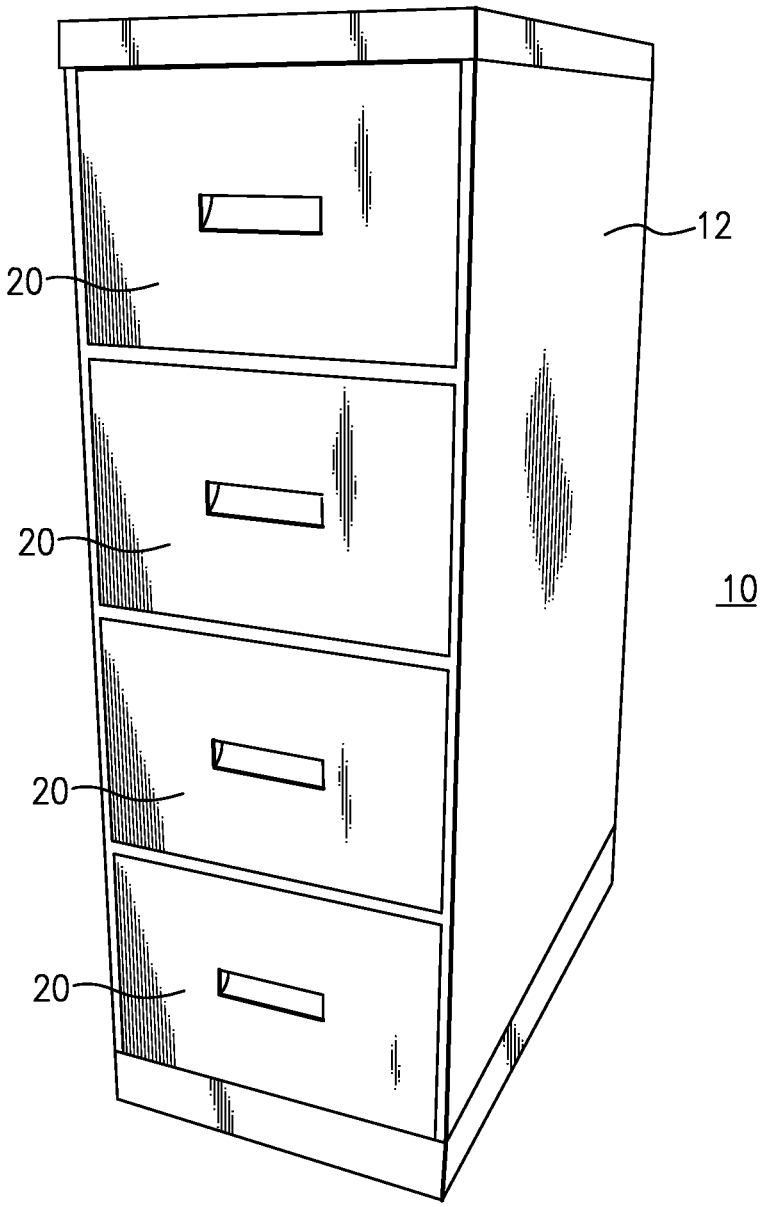
FIG. 1 is a perspective view of a secure filing cabinet, according to one embodiment of the invention.
Figure 2:
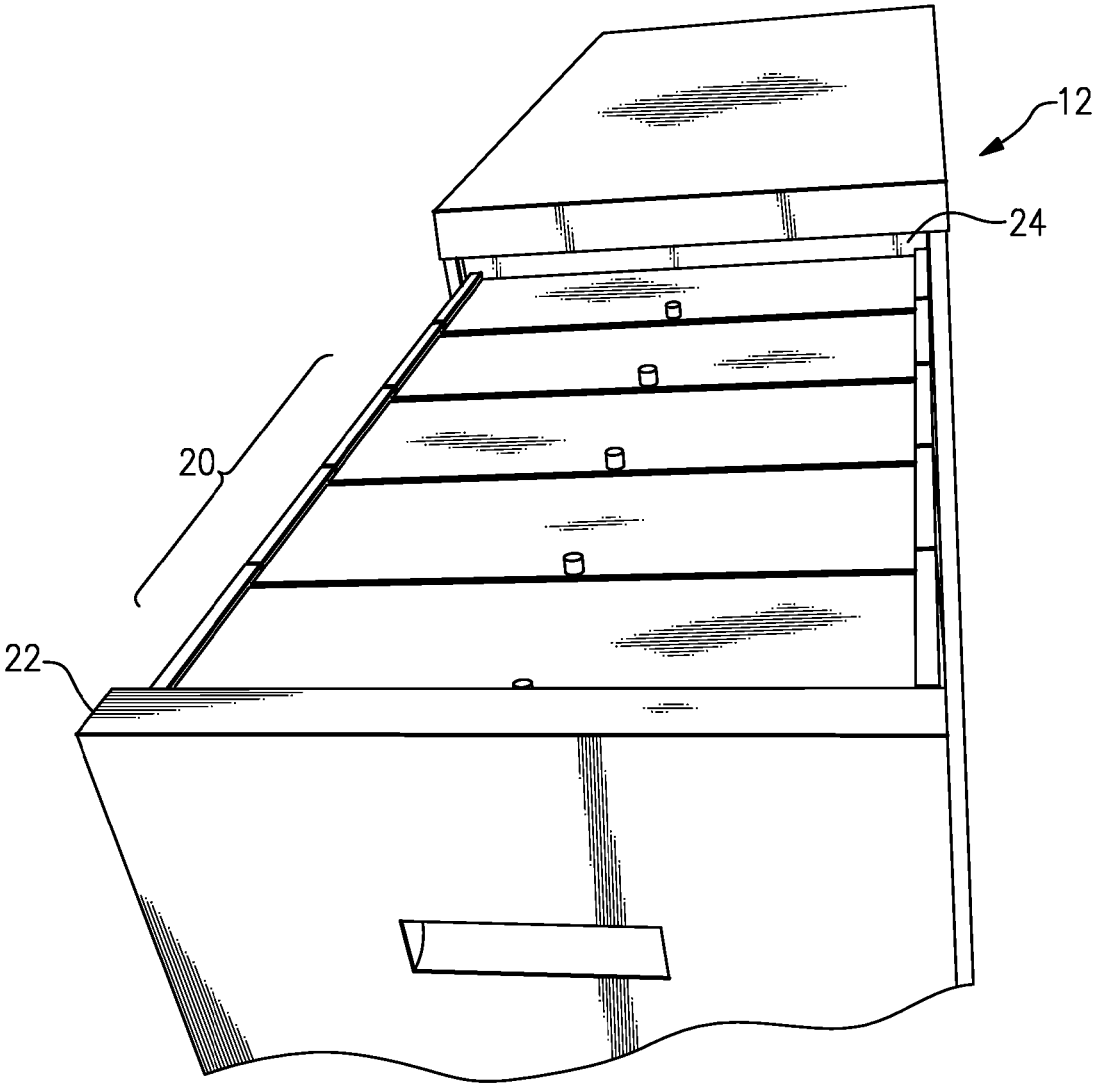
FIG. 2 is a front perspective view of the secure filing cabinet of this embodiment, showing a compartmented drawer open to reveal individual locking lids.

With reference to the Drawing, and initially to FIGS. 1 to 4, a secure filing cabinet 10 is shown as a free-standing cabinet, but may also be configured as wall-mounted cabinet, a portable cabinet mounted on wheels, or a one-drawer or two-drawer cabinet incorporated into a desk or other furniture. In this embodiment, the cabinet has a generally vertical frame including a side wall 12 and a back wall 14 (shown in other views) with a stack of file drawers 20, here arranged vertically one above the other. The invention, of course, comprehends also a lateral cabinet arrangement, although that is not illustrated. The drawers 20 each fit into a respective opening or aperture in the cabinet frame. FIG. 2 shows one drawer 20 as having been pulled open. The drawers may have an open configuration in which all materials in the drawer can be accessed once the drawer is pulled out, or as shown here may have a row of individual locking compartments. A proximal or front wall 22 of the drawer is provided with a handle or pull. A key-operated lock may be located on the cabinet to serve as an emergency override, although not shown in these views.

The drawer 20 as illustrated in FIG. 2 is an example of an embodiment in which the drawer is divided into individual locked compartments, each with a respective locking lid which is unlocked by entering an authorization code or the like. This particular file drawer is described in more detail below in respect to FIGS. 7 to 12. In this arrangement, the compartments are arranged as a single row of compartments extending from front to back between a front wall 22 of the drawer and a back wall 24 of the drawer. In other embodiments, there may be more than one row, and a similar configuration could be employed in a lateral-style file cabinet drawer.

Drawer slides, hangers, and many other mechanical parts can be conventional, and are not described in detail here, as the invention mainly concerns the locking and unlocking mechanisms, and the means for providing limited access for authorized persons.

Figure 3:
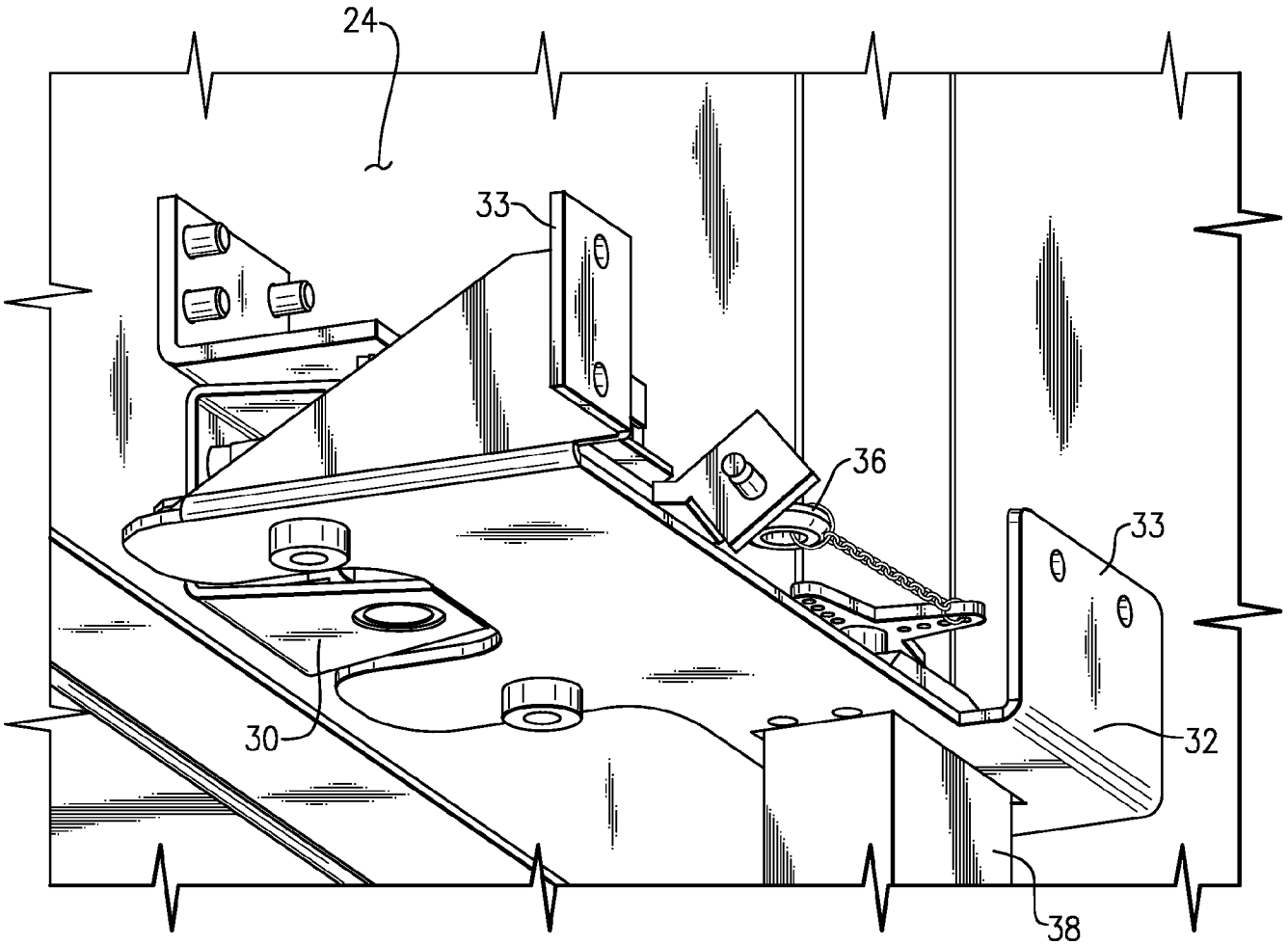
FIG. 3 is a perspective view of a drawer latch mechanism of this embodiment.
Figure 4:
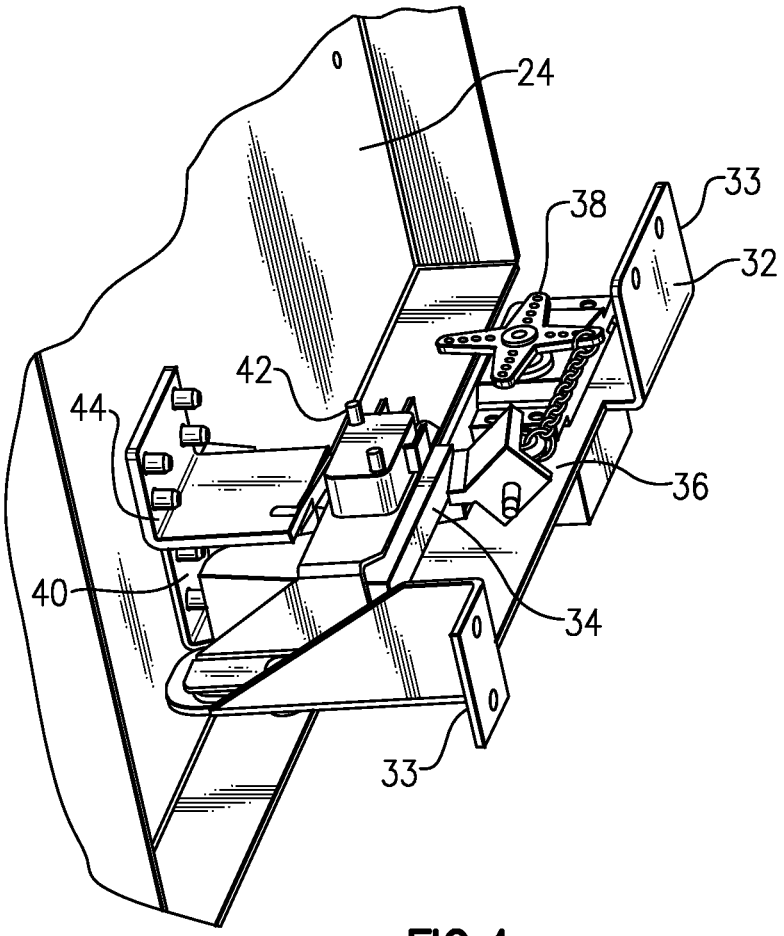
FIG. 4 is a top perspective view thereof.
Figure 5:
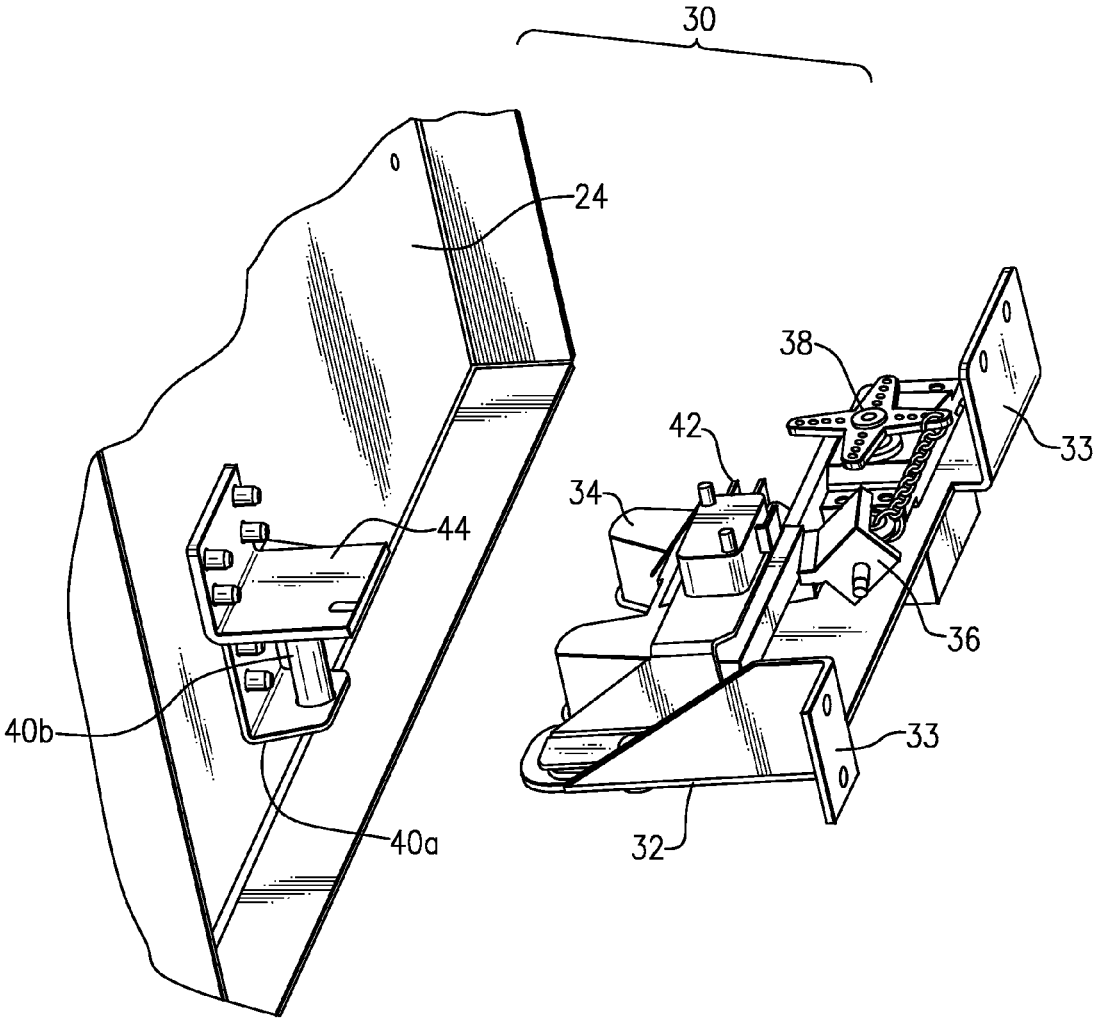
FIG. 5 is another perspective view of the latch mechanism, showing the latch and co-operating latch pin separated from one another.

FIGS. 3, 4, and 5 illustrate an embodiment of a latch mechanism 30 for holding the drawer 20 in a closed and locked condition when it is fully pushed in and for electro-mechanically releasing the drawer so it can be pulled out to its open position. The latch mechanism mechanically holds the drawer 20 closed, but opens to release the drawer when signaled by a controller, e.g., when an authorized user enters a proper ID code. There is one latch mechanism 30 provided for each of the drawers, with one portion mounted on the distal or back side of the rear wall 24 of each of the file drawers, and a corresponding latching portions mounted on the proximal side of the back wall 14 of the file cabinet.

As shown in these views, a latch frame 32 has flanges or ears 33 that are fastened, e.g., by bolts or rivets, onto the back wall 14 of the cabinet. A self-latching hook mechanism 34 is mounted at a central part of the latch frame 32 to engage a vertically oriented latch pin 40 that is mounted on the back wall 24 of the file cabinet drawer 20. A latch release, e.g., a release lever 36 is operationally coupled to the hook mechanism 34, and when pulled or moved, the release lever moves the hook part of the mechanism 34 so as to release the pin 40 so the drawer 20 can be pulled out. When the drawer is pushed fully in again, the action of the pin moves the hook mechanism 34 so the latter engages the latch pin 40 and holds the drawer closed, at least until the latch release lever 36 is moved.

A servo motor 38 is mounted to one side of the hook mechanism 34 on the latch frame 32, and in this embodiment the servo motor is provided with a horn or rotor. The rotor here has four arms, as is typical of many conventional servos. One arm of the rotor is connected, via a cable 39, to the release lever 36, and is operative to pull the release lever upon receiving an electrical command to disengage the hook mechanism 34 from the latch pin 40. Other electro-mechanical devices, e.g., a solenoid, may be used in place of the servo motor 38.

Figure 6:
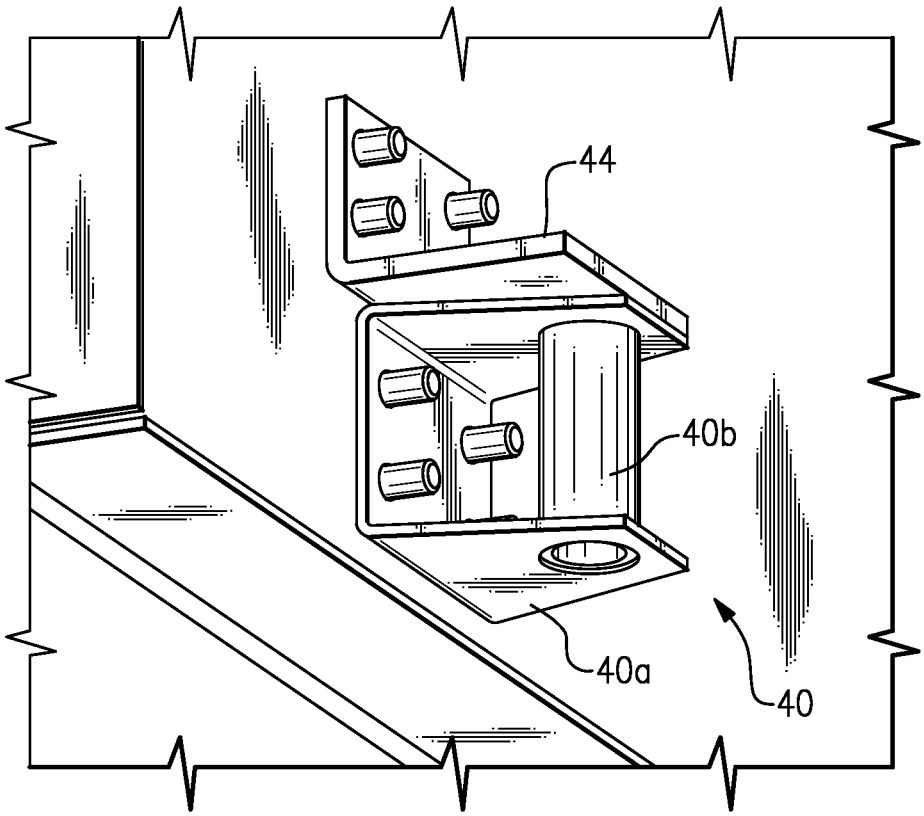
FIG. 6 is a perspective view of the latch pin.

The latch pin, better shown in FIG. 6, here includes a bracket 40*a* that is bolted or riveted to the rear or back wall 24 of the file drawer 20, and a vertical pin 40*b* that is oriented vertically and parallel to the drawer rear wall 24. The vertical pin is positioned so as to engage the self-latching hook mechanism 34 when the drawer is pushed in fully.

Figure 6A:
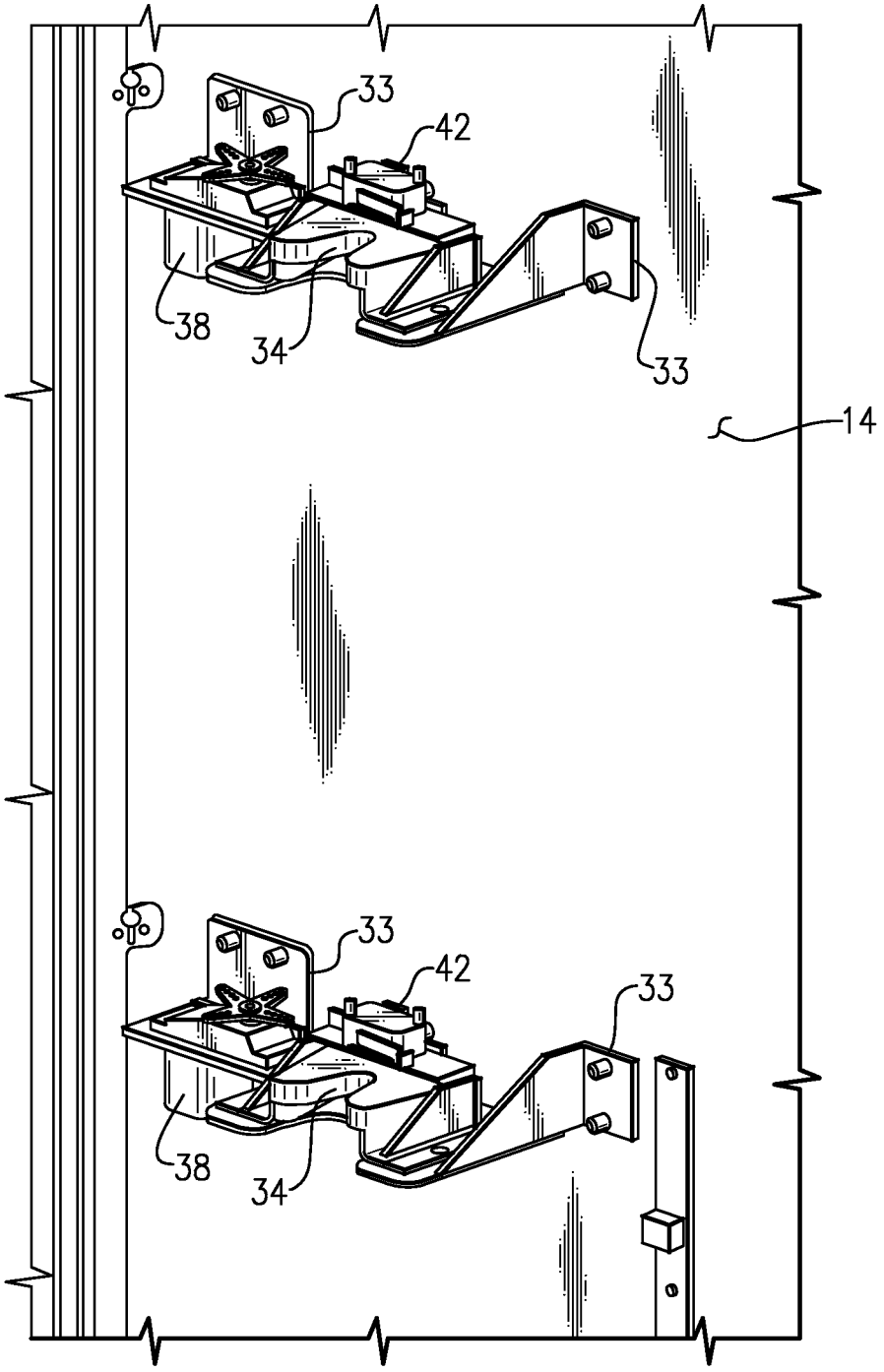
FIG. 6A is a perspective view of a pair of latch mechanisms of the secure file cabinet of this embodiment, mounted on a rear wall of the cabinet housing.

As shown in FIG. 6A, latch mechanisms 30 are provided, one above the other, on the back wall 14 of the file cabinet, with the frame ears 33 of each being bolted or riveted to the back wall. Two are shown here, but in practice there would be one for each locking file drawer.

Not shown here is a key unlock mechanism that provides emergency or supervisory keyed access to the drawers in the filing cabinet. In embodiments of this filing cabinet, this may involve having a keyed lock cylinder (or one cylinder per drawer) with a cable attached in the interior of the cabinet and coupled to the respective release lever(s) 36. The key override unlock system permits a supervisory authorized person to access the drawer, e.g., in the event of a mechanical or electrical failure or malfunction.

Also shown in these views is a microswitch 42 mounted on each of the latch frames 32. There is also an L-shaped bracket 44 affixed onto the back wall 24 of the respective file drawer just above the latch pin 40. The bracket 44 has a horizontal flange that projects forward and engages a switch lever of the microswitch 42 when the corresponding drawer 20 is fully pushed in. The microswitch provides a drawer-closed signal to the controller (to be discussed shortly). In place of the microswitch 42, as magnetic sensor or optical sensor could be used to signal when the drawer was pushed shut or was opened.

Figure 7:
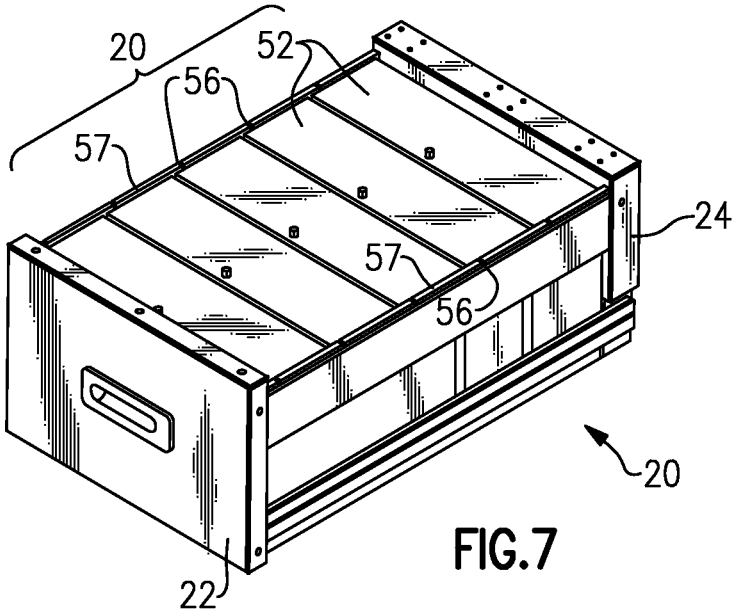
FIG. 7 is a perspective view of a drawer of the filing cabinet of this embodiment, with locking lids and individual secure compartments.
Figure 8:
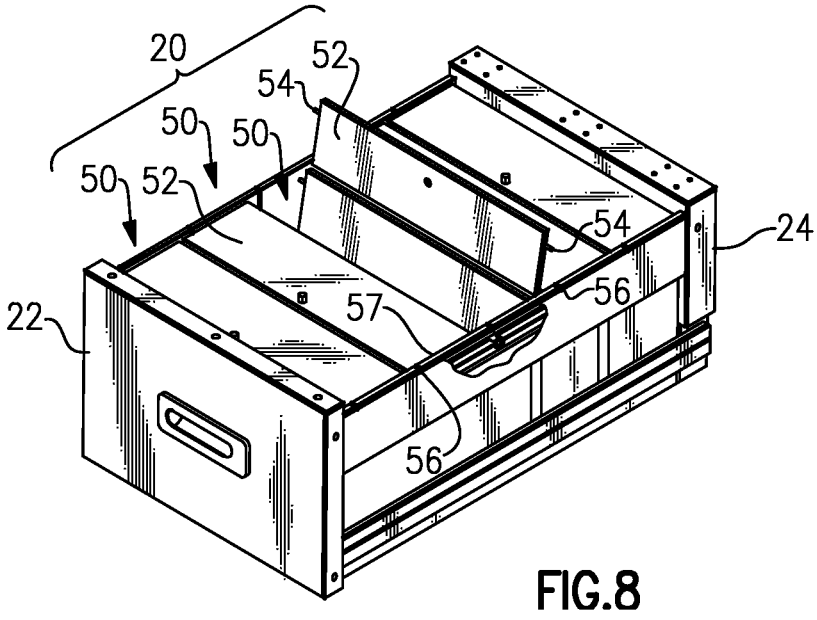
FIG. 8 is an another similar perspective view thereof, showing one locking lid released and lifted to an open position.

Turning now to FIGS. 7 and 8, which illustrate the locking compartment drawer discussed briefly in respect to FIG. 2, the drawer 20 is shown to have a number of individual locking compartments 50, arranged in a row extending front to back from the front wall 22 to the rear wall 24, each with its own locking lid 52. Each lid is supported on hinge pins that extend laterally, i.e., to right and left, from the distal part of the lid into the side walls of the drawer, and with lock pins 54 that extend laterally from the forward or proximal part of each lid 52. FIG. 8 shows one lid 52 in an open position, that is, unlocked and lifted open, to show the individual compartment 50 beneath the lid. Preferably, the lids 52 are each formed of a durable, rigid transparent plastic resin, so that the contents of the compartment are easily visible to the user, when the user accesses the compartments.

In this embodiment, there are slots 56 formed in covers 57 at the top edge of each of the two side walls of the drawer, corresponding to the locations of the respective lock pins 54, and there are slotted sliding lock bars within the side walls beneath these covers 56 for unlocking the lids 52 one at a time. The action and construction of the lids and slide bars is similar to what is shown and discussed in earlier patent applications of the same inventor and assignee, namely, Ser. No. 13/291,462, filed Nov. 8, 2011, and Ser. No. 13/765,146, filed Feb. 12, 2013, which discuss individual locking lid compartments in the context of a medication dispensing cabinet.

Figure 9:
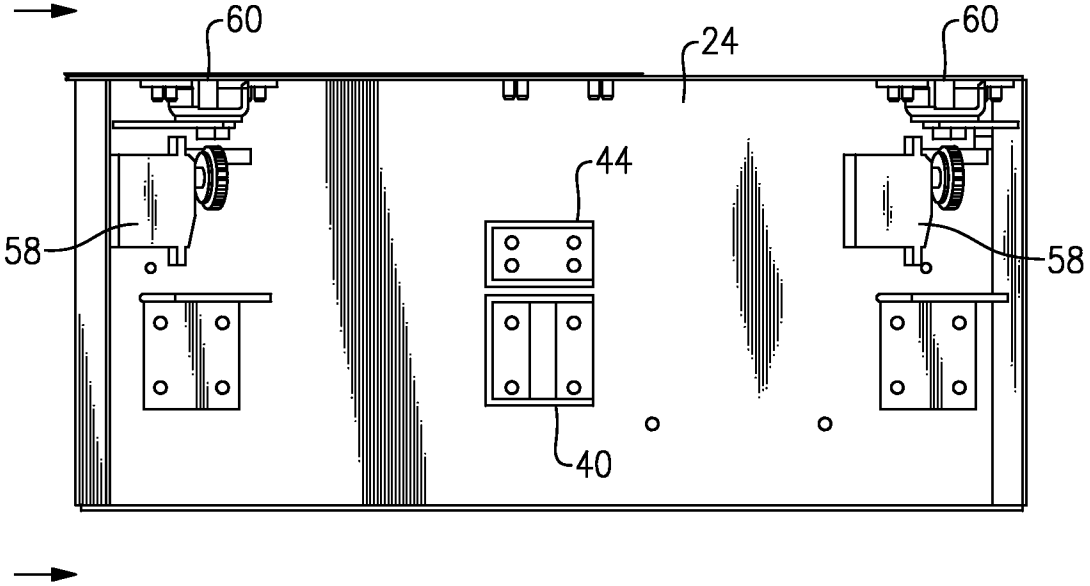
FIG. 9 is a perspective view of a back wall of the drawer of FIGS. 7 and 8.
Figure 10:
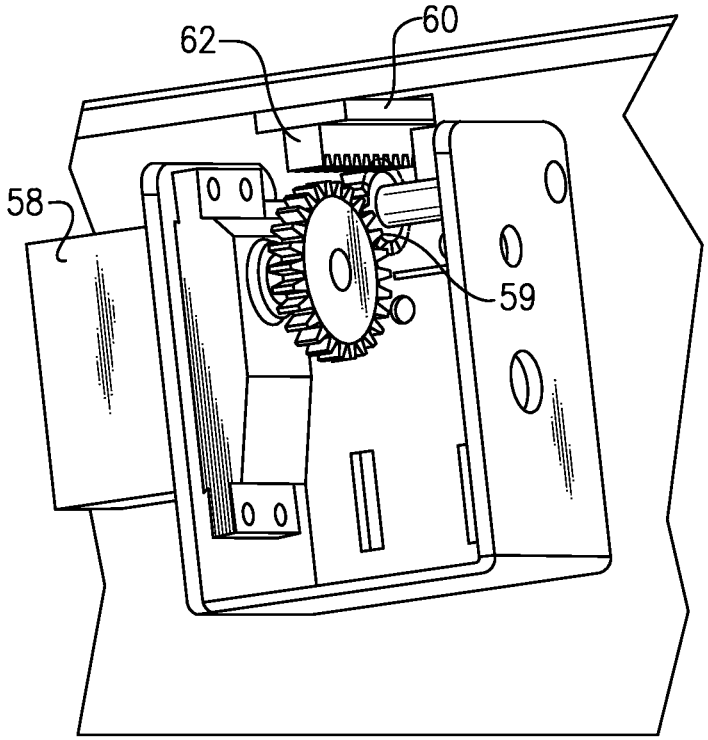
FIG. 10 is a perspective of the gearmotor employed in embodiments of this invention.
Figure 11:
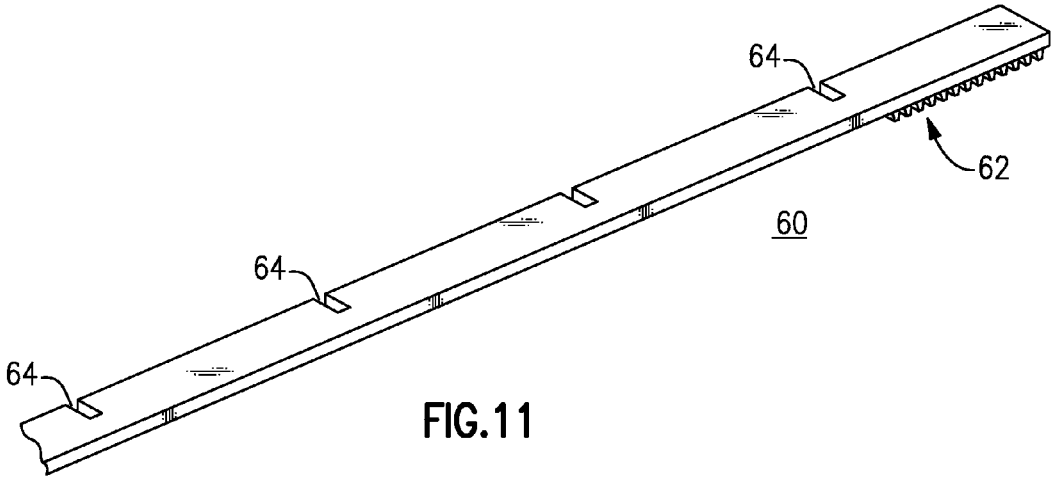
FIGS. 11 and 12 are perspective views of a distal end of the slotted slide bar employed in this embodiment, with FIG. 12 being enlarged to show the gear rack thereof.
Figure 12:
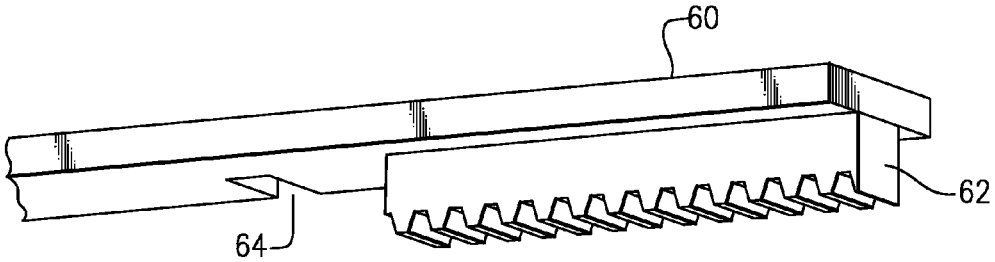

FIG. 9 shows the back or distal side of the drawer back wall 24, with gearmotor/servo mechanisms, here a left gear motor 58 and a right gear motor 58 for moving left and right slotted slide lock bars 60. The lock pin 40 and L-shaped bracket 40 are shown here disposed centrally on the back wall 24, and the gear motors 58 are positioned near the upper left and right corners. Details of the gear motor 58 appear in FIG. 10 with a frame supporting the gear motor 58 and a gear drive 59 that includes a pinion engaging a gear rack 62 at the distal end of the slide bar 60. Detail of the slide bar(s) 60 appears in FIGS. 11 and 12. Each of the slide bars is in the form of an elongated steel member, with slots 64 appearing along one side at specific locations along the side, so that for a given position of the slide bar 60 only one slot 64 will align with its respective locking pin 54. Also, there is an all-lock position in which none of the slots 64 align with a lock pin. The all-lock position (e.g., all the way to the distal end of its movement) is a default position and the bars are moved to that position when the drawer 20 is not being accessed and when it has been pushed in to its closed and locked position. A key lock (not shown) may also be incorporated into this drawer 20 for emergency over-ride access to the compartments.

Favorably, the front or proximal wall 22 of the drawer 20 is thick enough to allow for play or movement of locking slide bars, and the rear or distal wall 24 is also deep enough to conceal the distal ends of the slide bars and the gear motors, and to prevent manipulation of the slide bars when the drawer 20 is pulled out to its open position.

As more fully described in respect to the aforementioned prior patent documents Ser. No. 13/291,462 and Ser. No. 13/765,146, each compartment lid 52 has a pair of lock pins 54 which extend into an associated channel formed in the right or left side wall of the drawer, and each of the lids has a knob or handle or the like its forward edge to facilitate lifting the lid open. The lock pins 52 can favorably be embedded in the front portion of the lid to extend sidewards into the associated slide lock channels. The slide bars or lock bars are positioned so that for a given predetermined slide bar position one of the slots 64 in the bar 60 aligns with the lock pin 54 of one of the compartment lids 52. At that position, the other slots 64 are out of position to align with their respective lock pins. The slots on the side edge of the bar are located so that a different slot will align with lock pin for each of the lids at different positions of the slide bar. When the slide bar is in a position to allow a particular bin or compartment to be opened, the lids 52 to all the other bins or compartments 50 in the drawer 20 are held locked. In other embodiments, the lock pins 54 could be molded or forged integrally with the associated lid 52.

Favorably, the slide bars can be formed as elongated, flat bars of anodized aluminum with slots 64 formed at the predetermined locations along one or both of the two edges. In a favorable embodiment, the slots 64 can positioned so that as the bar 60 is moved in 3/16 inch increments, the different slots 44 will align with their respective lock pins 42, one lock pin at a time. Each of the slide bars is calibrated to have a number of positions so that there is one position for each of the locking lids, plus one position at which all the compartments are locked.

The gear motors 58 are independently controlled by logic and control circuitry, discussed shortly, and preferably arranged so that when a given compartment is being accessed, the left and right slide bars are moved one at a time so as to limit current draw. The gear motors may be indexed to move in increments so as to align the bar with the respective slot and lock pin for the lid of the desired bin or compartment. The logic and control circuitry can be driven by an associated computer or similar device that has a memory containing the identity of contents of each of the compartments in the drawer so that the slide lock bar will be moved to the appropriate location to access the files or documents needed. In alternative arrangements, an encoder or potentiometer may be employed for positioning or locating purposes. Not-shown slots in the bottom of the gear motor bracket are used as part of the calibration process to adjust the locking bar to the proper position, at factory set-up or if field alignment is required.

An optional LED light arrangement (not shown) may include LEDs located along the side wall(s) of the drawer to indicate which bin or compartment has been unlocked. Alternatively, lock pins can be anodized a bright color, e.g., red, for easy visibility when aligned with the respective slot in the slide bar, or the locking slide bar can be anodized a distinctive color, so that it becomes apparent when a slot is aligned with a locking pin.

In the embodiments described here, the control circuitry is suitably programmed so that the locking bar or slide bars are moved first before the drawer 20 can be unlocked and pulled open. That is, the slide bars only move when the drawer is shut and closed, so that only a single compartment can be accessed. For security, before a different compartment in the same drawer can be accessed, the associated software requires that the drawer 20 be first shut by the user and re-locked before another compartment in the same drawer can be accessed. That is, both slide bars must be in their home or all-lock position, and the drawer 20 closed, before the slide bars can be moved to the position to release the second compartment lid.

Figure 13:
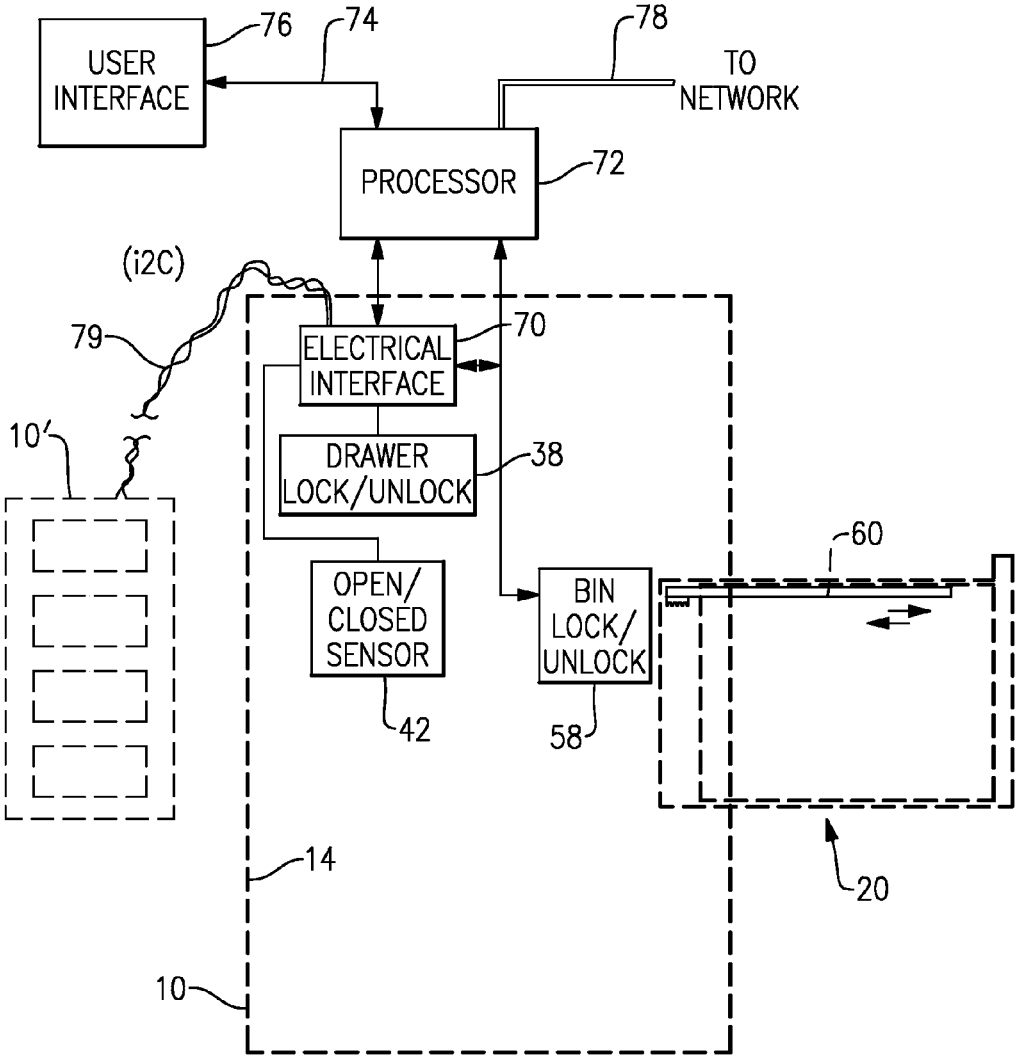
FIG. 13 is a schematic view to illustrate the electronic interconnections employed in this embodiment.

As illustrated schematically in FIG. 13, the basic control circuit arrangement may include an electrical interface 70, e.g., a printed circuit board, disposed within the frame or body of the filing cabinet 10. For each drawer 20 in the filing cabinet, the interface 70 has an output port connected to the drawer lock/unlock mechanism, e.g., connected to the associated servo motor 38, and also has an input port connected with the associated open/closed detector, e.g., microswitch 42. The interface may be connected externally (wired or wirelessly) to a computer controller processor 72 e.g., a standard lap top unit or touch screen tablet unit that may be incorporated into the cabinet 10 or supported on the cabinet, and may be connected via a cable or bus 74 with a user interface 76. The interface 76 may include a card reader, biometric sensor, RFID reader, or other mechanism that can capture the identity of the user, and require authentication, via a password or code. This allows the processor 76 to create an audit trail of access to the various drawers and compartments to make a record of time of access and user identity for each drawer and/or compartment. The computer processor 72 also keeps track of the physical location of each document or other material stored in each storage location, i.e., drawer or compartment, within the cabinet.

The processor 72 and/or the electrical interface 70 will insure that each of the multi-compartment file drawers 20 is closed before signaling the associated gear motors 58 to move the slide bars 60 for that drawer, and will ensure that all of the drawers 20 of the filing cabinet 10 are fully closed before signaling any of the latch servo motors 38 to pull the associated release lever and unlatch its respective file drawer.

In the preferred embodiment, the interface 70, servo motors 38 and gear motors 58 are battery powered from an included DC power source within the cabinet, so that the file cabinet is operated at a safe low voltage. The battery or batteries may be trickle charged from the computer network or from a re-charging source.

The cabinet 10 of this invention may be connected to another or several additional filing cabinets 10' (shown here in broken line) via a daisy chain, e.g., i2c cable 79. Each additional cabinet may have its own interface, and can have one or more locking file drawers, with our without multiple-compartment locking lid construction as discussed above. The cabinets 10, 10", etc. can be linked together in a daisy-chain configuration, connecting one cabinet to the next or nearest one, and with the cabinet nearest the PC or processor 72 at the start of the daisy chain being connected to a USB port of the processor.

Figure 14:
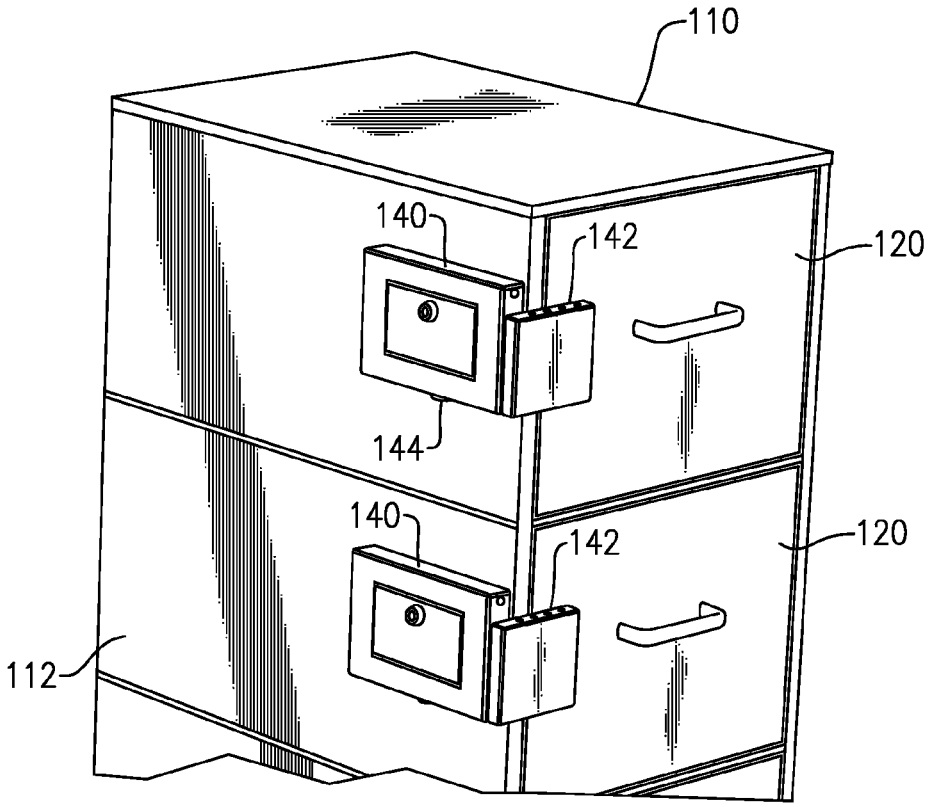
FIGS. 14 and 15 are perspective views for illustrating an alternative secure file cabinet embodiment of this invention
Figure 15:
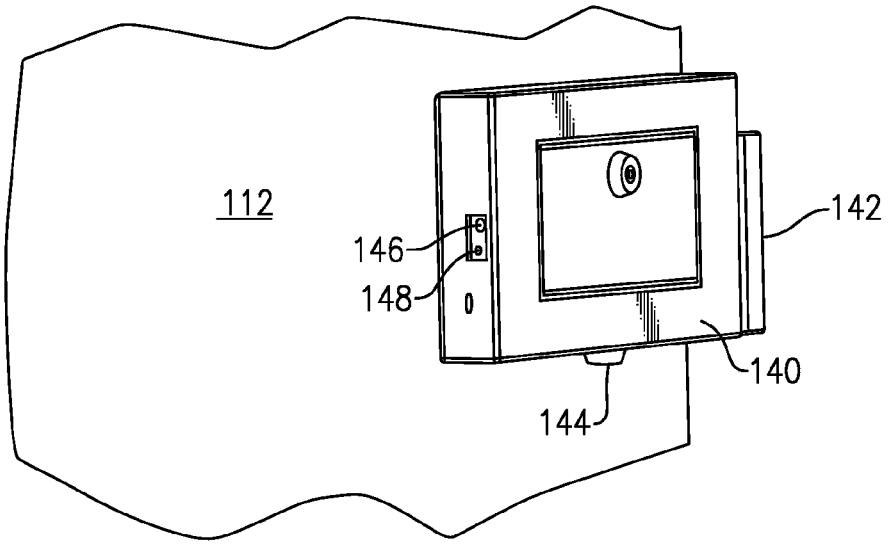

FIGS. 14 and 15 show an arrangement in which existing mechanical filing cabinets may be field-modified so that at least some filing drawers can be remotely locked and unlocked. These modified filing cabinets may be daisy-chained, for example, to the locking filing cabinet 10 discussed above, or to a remote computer processor. Here one file cabinet 110 is shown in which an external lock mechanism 140 is affixed onto one side panel or side of the file cabinet for each drawer 120 that is to be provided with the limited access provision, and a corresponding latch plate 142 is mounted onto the front wall 122 of the drawer. The latch plate 142 automatically locks into the lock mechanism 140 when the file drawer is pushed closed, and is released when the lock mechanism is remotely unlocked. A key over-ride lock 144 provides for emergency over-ride access (with the key being possessed only by person or persons with supervisory authority). At one side of the housing of the lock mechanism 140 is a data port 146, i.e., a USB port and/or i2c connection port and/or ethernet port, for connecting to the remote locking and unlocking system. In addition there is a 12-volt power inlet 148. The two locking drawers of this additional cabinet 110 can be remotely locked and unlocked via the cable 79 of FIG. 13. An unlimited number of additional filing cabinets can be added to the system, linking each cabinet to the next.

The lock mechanism 140 may include a latching mechanism similar in principle to the self-locking, electro-mechanical unlocking mechanism described in reference to FIGS. 3-5, or may employ a solenoid in place of the servo motor. This may lock by capturing a latch pin or the like carried on the associated latch plate 142. The lock mechanism 140 may include an internal DC power source.

The arrangements and embodiments of this invention have the attribute of secure storage of sensitive documents in one location or in multiple locations, and can achieve this with a simple, low cost arrangement. For some highly sensitive documents or materials, a two-person authorization may be required, which can be easily implemented on this system. Similarly, methods employing RFID identification or bar code scanning of individual documents or materials can also be added for security and for compliance with storage regulations and protocols.

The file cabinets of this invention ensure that the file drawer or drawers will automatically lock when closed, even in the event of a power failure or malfunction. Only one drawer may be opened at a time, both for document security and to prevent instability caused by having the weight of more than one drawer extended forward of the base of the cabinet, preventing dangerous tipping from having more than one drawer open at a time. The opening of the cabinet may be software controlled, i.e., password and ID protected, or using some combination of barcode/RFID/biometric/magnetic stripe/smartcard plus a password.

A full audit trail is accomplished, identifying who used any given file, who exercised access to a given file drawer or compartment, and who currently possesses the file. Bar coded files or RFID coded files are scanned when placed into the file drawer and when removed from the file drawer. A centralized networked database keeps track of stored files over multiple cabinets. Some of the drawers may permit access to only one of multiple sections of the drawer at any one time, with different levels of access for different compartments. Existing cabinets may be modified using a bolt-on lock module to upgrade existing filing cabinets so that they may be included in the secure file network. This also permits a confidential or valuable file to be removed from a central storage location and securely stored at an employee location in a retro-fitted existing cabinet, and permit the file to be fully tracked.

One drawer of a cabinet may be used as a secure waste bin, with electronic locking and audit trail. The waste-bin file cabinet compartment or drawer may have a drop in slot for the document to be destroyed, and may have access limited only to secure document destruction personnel.

While the invention has been described hereinabove with reference to selected preferred embodiments, it should be recognized that the invention is not limited to those precise embodiments. In particular, in some preferred embodiments there can be a key-locked compartment within, to provide an additional layer of protection for controlled substances located within the locked compartments of the locked drawer. Many modification and variations would present themselves to persons skilled in the art without departing from the scope and spirit of this invention, as defined in the appended claims.

What is claimed is:

1. A storage cabinet arrangement for secure storage of documents and/or other materials for which limited authorized access is to be provided, comprising:

a cabinet including left and right side walls, a rear wall, and a front frame having at least one drawer opening;

at least one respective sliding file drawer mounted in an associated one of said at least one drawer opening of the front frame and having at least one back wall, the file drawer being adapted to be pulled proximally out from said cabinet to an open position for permitting access to contents of said file drawer, and to be pushed distally in to the cabinet to a closed position in which the back wall of the file drawer is positioned adjacent the rear wall of the cabinet;

a locking mechanism for releasably locking the at least one file drawer in its closed position within said cabinet, the locking mechanism including for each of said at least one file drawer:

a latch pin affixed onto the back wall of each of said at least one drawer in a position oriented parallel to the back wall thereof; and a latch mechanism mounted on the rear wall of said cabinet and aligned with the latch pin of a respective one of said at least one file drawer, the latch mechanism including a mechanical latch hook that engages said latch pin in a locked position when said latch pin is pushed into engagement therewith; a latch release coupled to said latch hook for moving said latch hook to release the latch pin so that the drawer may be pulled out to its open position, and an electromechanical actuator coupled to said latch release;

a controller mounted within said cabinet having an input and at least one output coupled to the electromechanical actuator of the associated latch mechanism; and an interface arrangement coupled to the input of said controller for permitting an authorized person to interface with said controller to release the latch mechanism from the latch pin of one of said at least one file drawer to permit the drawer to be pulled out to its open position;

wherein the at least one file drawer comprises a front wall and left and right side walls extending from said front wall to said back wall, and each of said right and left side walls includes an elongated channel portion extending along the top thereof from the back wall to the front wall; and the at least one file drawer further including a plurality of transverse dividers situated between the left and right side walls and which define individual storage compartments within said file drawer;

each of said storage compartments having a lid that is normally locked down but is selectively releasable to permit the lid to open for access to the associated compartment, each said lid having a hinge pin extending out of a rear portion thereof and journaled in said left and right side walls to permit the lid to pivot from a lowered closed position to a raised open position, and wherein a lock pin extends from each of the right and left edges of the lid into the respective channel portion;

left and right slide bars disposed in the respective channel portions of said side walls and adapted to move for at least a limited distance along the respective channel portions, said slide bars each having slots along side edges thereof which slots align with the respective lock pins of said compartment lids when said slide bars are moved to different respective positions along said channel portions, and such that any compartment lid in which the lock pins align with the respective slots in said slide bars may be lifted open, but the remaining lids in said at least one file drawer are blocked from opening; said slide bars each having ends projecting into the and back wall of said at least one file drawer; and further including controlled motor means affixed onto the back wall of said at least one file drawer for moving each of said slide bars to selected positions so as to align, at each selected position, a given slot of each of said left and right slide bars with the lock pin of a selected one of said compartments to permit the associated lid to be lifted open but to lock each of the other of the lids from opening; with the front wall of said at least one file drawer being sufficiently thick to allow for play or movement of the slide bars, and the back wall of said at least one file drawer being sufficiently deep to conceal the ends of the slide bars and the controlled motor means and to prevent manipulation of the slide bars when the at least one file drawer is pulled out to its open position.

2. A storage cabinet arrangement according to claim 1, wherein said interface arrangement includes a cable port connected to the controller, a computer device, and a cable coupling the computer device to said cable port.

3. A storage cabinet arrangement according to claim 1, wherein said controlled motor means includes first and second gear motors mounted on said back wall at left and right sides thereof, and each said gear motor having a toothed pinion, and wherein the associated slide bars each have a gear rack disposed at a distal end thereof, the pinions of the gear motors meshing with the gear racks of the respective left and right slide bars.

4. A storage cabinet arrangement according to claim 3, wherein said controlled motor means is controlled such that each of said gear motors is operative to move the respective slide bar only when said file drawer is detected to be fully in its closed position, and is inhibited from moving the respective slide bar when the at least one file drawer is in its open position.

5. A storage cabinet arrangement according to claim 3, wherein said controlled motor means are controlled such that one of said first and second gear motors is actuated to move its associated slide bar, and only after that associated slide bar has moved to in its desired position, the other of said gear motors is actuated to move its associated slide bar to its desired position.

6. A storage cabinet arrangement according to claim 1, wherein one of said controller and said interface includes software that limits access to drawers of the cabinet to specific users, and maintains an inventory of the contents of said drawers, and creates an audit trail of users accessing said drawers.

7. A storage cabinet arrangement for secure storage of documents and/or other materials for which limited authorized access is to be provided, comprising:

a cabinet including left and right side walls, a rear wall, and a front frame having a plurality of drawer openings disposed vertically one above the other;

a plurality of sliding file drawers mounted in respective ones of said drawer openings of the front frame and each drawer having at least one back wall, the file drawers being adapted to be pulled proximally out from said cabinet to an open position for permitting access to contents thereof, and to be pushed distally into the cabinet to a closed position in which the back wall of the file drawer is positioned adjacent the rear wall of the cabinet;

a locking mechanism for releasably locking said file drawers in their closed positions within said cabinet, the locking mechanism including for each of said file drawers:

a latch pin affixed onto the back wall of each of the file drawer in a position oriented parallel to the back wall thereof; and a latch mechanism mounted on a front side of the rear wall of said cabinet and aligned with the latch pin of a respective one of said at least one file drawer, each said latch mechanism including a mechanical latch hook that engages the respective latch pin in a locked position when said latch pin is pushed into engagement therewith; a latch release coupled to said latch hook for moving said latch hook to release the latch pin so that the drawer may be pulled out to its open position, and an electromechanical actuator coupled to said latch release, and a presence sensor mounted on said latch mechanism at the front side of the rear wall and detecting when the associated file drawer has been pushed in to said closed position such that said latch pin engages said latch hook, and providing a presence signal;

a controller mounted within said cabinet having an at least one input and at least one output, the output being coupled to the electromechanical actuators of the associated latch mechanisms, and the at least one input of the controller receiving the presence signals from the presence sensors of said latch mechanisms; and an interface arrangement coupled to the input of said controller for permitting an authorized person to interface with said controller to release the latch mechanism from the latch pin of one of said at least one file drawer to permit the drawer to be pulled out to its open position, and wherein the controller is operative to energize any of said electromechanical actuators only if the presence signals indicate that every one of said drawers is in its closed position, such that none of associated latch mechanisms can be moved to release the respective file drawers unless all of the file drawers are pushed in to their closed position; and wherein said presence sensors each comprise a microswitch having a switch lever, the microswitch being mounted at a predetermined position upon said latch mechanism, and a bracket affixed onto the back wall of the associated file drawer on the side of the cabinet back wall facing the associated file drawer, and having a horizontal tab thereon above and adjacent to the associated latch pin and projecting distally a predetermined distance so as to be positioned to press against the switch lever of said microswitch when the file drawer is in its closed position at the point where the latch mechanism engages the respective latch pin.

8. A storage cabinet arrangement according to claim 7 wherein said electromechanical actuator includes a servo motor having a rotor with at least one rotor arm, and a cable connecting said rotor arm to the associated release lever and operative to pull said release lever when said servo motor is actuated.

9. A storage cabinet arrangement according to claim 7 comprising a key-operated lock over-ride, having a key-actuated lock cylinder, and a cable connecting between said lock cylinder and the release arm of at least one of said latch mechanisms.

10. A storage cabinet arrangement according to claim 7 wherein at least one of said file drawers comprises a front wall and left and right side walls extending from said front wall to said back wall, and each of said right and left side walls includes an elongated channel portion extending along the top thereof from the back wall to the front wall; and including a plurality of transverse dividers situated between the left and right side walls and which define individual storage compartments within said file drawer;

each of said storage compartments having a lid that is normally locked down but is selectively releasable to permit the lid to open for access to the associated compartment, each said lid having a hinge pin extending out of a rear portion thereof and journaled in said left and right side walls to permit the lid to pivot from a lowered closed position to a raised open position, and wherein a lock pin extends from each of the right and left edges of the lid into the respective channel portion;

left and right slide bars disposed in the respective channel portions of said side walls and adapted to move for at least a limited distance along the respective channel portions, said slide bars each having slots along side edges thereof which slots align with the respective lock pins of said compartment lids when said slide bars are moved to different respective positions along said channel portions, and such that any compartment lid in which the lock pins align with the respective slots in said slide bars may be lifted open, but the remaining lids in said file drawer are blocked from opening.

11. A storage cabinet arrangement according to claim 10, comprising controlled motor means on the back wall of said file drawer for moving each of said slide bars to selected positions so as to align, at each selected position, a given slot of each of said left and right slide bars with the lock pins of a selected one of said compartments to permit the associated lid to be lifted open but to lock each of the other of the lids from opening.

12. A storage cabinet arrangement according to claim 11, wherein said controlled motor means includes first and second gear motors affixed onto said back wall of said file drawer at left and right sides of said back wall, and each said gear motor having a toothed pinion, and wherein the associated slide bars each have a gear rack disposed at a distal end thereof, the pinions of the gear motors meshing with the gear racks of the respective left and right slide bars.

13. A storage cabinet arrangement according to claim 12, wherein said controlled motor means is controlled such that each said gear motors is operative to move the respective slide bar only when said file drawer is detected to be in its closed position with the latch pin engaging the associated latch hook, and is inhibited from moving the respective slide bar when the file drawer is in its open position.

14. A storage cabinet arrangement according to claim 12, wherein said controlled motor means are controlled such that one at a time of said first and second gear motors is actuated to move its associated slide bar, and only after that associated slide bar has moved to its desired position, the other of said gear motors is actuated to move its associated slide bar to its desired position.

15. A storage cabinet arrangement according to claim 7, wherein each said channel portion includes a cover, and the respective covers each have a slot openings at corresponding locations of the lock pins of said lids.

16. A storage cabinet arrangement according to claim 10, wherein one of said controller and said interface arrangement includes software that limits access to predetermined locked-lid compartments of predetermined drawers of the cabinet to specific users, and maintains an inventory of the contents of said compartments, and creates an audit trail of users accessing said compartments.

17. A storage cabinet arrangement according to claim 7, comprising at least one additional file cabinet having at least one drawer and an associated electro-mechanically releasable locking mechanism for releasably locking said at least one file drawer in the closed position thereof within said additional cabinet; means for electrically connecting the first-mentioned cabinet with said at least one additional file cabinet in a daisy chain such that the interface arrangement is operative to release the locking mechanism for the at least one file drawer of said at least one additional cabinet; and wherein one of said controller and said interface arrangement includes software that limits access to predetermined ones of the at least one drawer of the at least one additional cabinet to specific users, and maintains an inventory of the contents of said at least one drawer, and creates an audit trail of users accessing said at least one drawer.

18. A storage cabinet arrangement according to claim 12, wherein the front wall and the back wall of each said file drawer contain ends of the associated slide bars, and each being sufficiently thick to conceal the ends of the slide bars and to prevent manipulation of the slide bars when the file drawers are pulled out to the open position.

* * * * *

UNITED STATES PATENT AND TRADEMARK OFFICE

CERTIFICATE OF CORRECTION

PATENT NO. : 9,289,061 B2
APPLICATION NO. : 14/185225
DATED : March 22, 2016
INVENTOR(S) : Norman A. Shoenfeld It is certified that error appears in the above-identified patent and that said Letters Patent is hereby corrected as shown below:

In the Claims:

Please correct claims 1, 8 and 18 to read as follows:

Col. 10, ln. 58-67 & col. 11, ln. 1-67 & col. 12, ln. 1-7, Claim 1.

(1) A storage cabinet arrangement for secure storage of documents and/or other materials for which limited authorized access is to be provided, comprising:
a cabinet including left and right side walls, a rear wall, and a front frame having at least one drawer opening; at least one respective sliding file drawer mounted in an associated one of said at least one drawer opening of the front frame and having at least one back wall, the file drawer being adapted to be pulled proximally out from said cabinet to an open position for permitting access to contents of said file drawer, and to be pushed distally in to the cabinet to a closed position in which the back wall of the file drawer is positioned adjacent the rear wall of the cabinet;
a locking mechanism for releasably locking the at least one file drawer in its closed position within said cabinet, the locking mechanism including for each of said at least one file drawer;
a latch pin affixed onto the back wall of each of said at least one drawer in a position oriented parallel to the back wall thereof; and
a latch mechanism mounted on the rear wall of said cabinet and aligned with the latch pin of a respective one of said at least one file drawer, the latch mechanism including a mechanical latch hook that engages said latch pin in a locked position when said latch pin is pushed into engagement therewith; a latch release coupled to said latch hook for moving said latch hook to release the latch pin so that the drawer may be pulled out to its open position, and an electromechanical actuator coupled to said latch release;
a controller mounted within said cabinet having an input and at least one output coupled to the electromechanical actuator of the associated latch mechanism; and Signed and Sealed this
Twenty-eighth Day of June, 2016

Michelle K. Lee

Michelle K. Lee
*Director of the United States Patent and Trademark Office* an interface arrangement coupled to the input of said controller for permitting an authorized person to interface with said controller to release the latch mechanism from the latch pin of one of said at least one file drawer to permit the drawer to be pulled out to its open position;
wherein the at least one file drawer comprises a front wall and left and right side walls extending from said front wall to said back wall, and each of said right and left side walls includes an elongated channel portion extending along the top thereof from the back wall to the front wall; and the at least one file drawer further including a plurality of transverse dividers situated between the left and right side walls and which define individual storage compartments within said file drawer; each of said storage compartments having a lid that is normally locked down but is selectively releasable to permit the lid to open for access to the associated compartment, each said lid having a hinge pin extending out of a rear portion thereof and journaled in said left and right side walls to permit the lid to pivot from a lowered closed position to a raised open position, and wherein a lock pin extends from each of the right and left edges of the lid into the respective channel portion; left and right slide bars disposed in the respective channel portions of said side walls and adapted to move for at least a limited distance along the respective channel portions, said slide bars each having slots along side edges thereof which slots align with the respective lock pins of said compartment lids when said slide bars are moved to different respective positions along said channel portions, and such that any compartment lid in which the lock pins align with the respective slots in said slide bars may be lifted open, but the remaining lids in said at least one file drawer are blocked from opening; said slide bars each having ends projecting into the front and back wall of said at least one file drawer; and further including controlled motor means affixed onto the back wall of said at least one file drawer for moving each of said slide bars to selected positions so as to align, at each selected position, a given slot of each of said left and right slide bars with the lock pin of a selected one of said compartments to permit the associated lid to be lifted open but to lock each of the other of the lids from opening; with the front wall of said at least one file drawer being sufficiently thick to allow for play or movement of the locking slide bar, and the back wall of said at least one file drawer each being sufficiently thick deep to conceal the ends of the slide bars and the gear motors and to prevent manipulation of the slide bars when the at least one file drawer is pulled out to its open position.

Col. 13, ln. 41-46, Claim 8.

(8) A storage cabinet arrangement according to Claim 7 wherein said electromechanical actuator includes a servo motor having a rotor with at least one rotor arm, and a cable connecting said rotor arm to the associated latch release and operative to pull said release lever when said servo motor is actuated.

Col. 15, ln. 4-9, Claim 18.

(18) A storage cabinet arrangement according to Claim 12, wherein the front wall of each said at least one file drawer is sufficiently thick to allow for play or movement of the locking slide bar, and the back wall of said at least one file drawer each is sufficiently deep to conceal the ends of the slide bars and the gear motors and to prevent manipulation of the slide bars when the file drawers are pulled out to the open position.